US005604996A

United States Patent [19]

Bestwick et al.

[11] Patent Number: 5,604,996

[45] Date of Patent: Feb. 25, 1997

[54] GRAIN SAMPLER AND METHOD FOR BATCH GRAIN DRYER

[75] Inventors: Ronald Bestwick, Taylorville; Jeffrey D. Decker, Lerna, both of Ill.

[73] Assignee: The GSI Group, Assumption, Ill.

[21] Appl. No.: 515,486

[22] Filed: Aug. 15, 1995

[51] Int. Cl.[6] ..... F26B 3/00

[52] U.S. Cl. ..... 34/484; 34/236; 73/863.52; 73/863.54; 73/863.81

[58] Field of Search ..... 34/233, 174, 65, 34/167, 170, 232, 236; 73/863.41, 863.51, 863.52, 863.81, 863.86, 863.54

[56] References Cited

U.S. PATENT DOCUMENTS

| | | | |
|---|---|---|---|
| 2,379,921 | 7/1945 | Pizzirani et al. | 73/863.51 |
| 3,479,748 | 11/1969 | Sietmann | 347/33 |
| 3,943,636 | 3/1976 | Sietmann et al. | 34/44 |
| 4,152,840 | 5/1979 | Stille | 34/575 |
| 4,156,507 | 5/1979 | Gokabowski et al. | 241/75 |
| 4,599,809 | 7/1986 | Parkes | 34/484 |
| 4,663,978 | 5/1987 | Lenski et al. | 73/863.52 |
| 4,750,273 | 6/1988 | Parkes | 34/484 |
| 4,838,094 | 6/1989 | Baldock | 73/863.81 |
| 4,918,999 | 4/1990 | Wenshau et al. | 73/863.54 |
| 5,020,246 | 6/1991 | Rust et al. | 34/236 |

OTHER PUBLICATIONS

Interstate Systems brochure showing cross-cut sampler and mechanical divider for taking representative grain sample.
Seedburo catalog pp. 36 and 37 showing laboratory dividers.
Grain Systems, Inc. brochure re TOP DRY ® grain dryer.

*Primary Examiner*—Henry A. Bennett
*Assistant Examiner*—Dinnatia Doster
*Attorney, Agent, or Firm*—Polster, Lieder, Woodruff & Lucchesi

[57] ABSTRACT

Apparatus for drawing a sample of grain from a stream of grain flowing along a path is described in which a tube extends into the grain flow path for diverting a portion of the flowing grain along the path to a sample collection station. The diverter diverts only a portion of the grain flowing along the path and the balance of the grain flowing along said sampling path is permitted to flow. A collector is provided for collecting at least a portion of the grain flowing to the sample collection station so as to accumulate grain for a sample that is representative of all of the grain flowing along the path for the time that the grain is being collected for the sample.

21 Claims, 3 Drawing Sheets

GRAIN SAMPLER AND METHOD FOR BATCH GRAIN DRYER

BACKGROUND OF THE INVENTION

This invention relates to a grain sampler, and more particularly to a grain sampler for use with a batch grain dryer incorporated with a grain storage.

Such batch grain dryer/storage bins are used for drying batches of grain and for subsequent conditioning and storage of various types of grains. Such bins are shown, for example, in U.S. Pat. Nos. 3,943,636, and 3,479,748. Such a batch grain dryer/storage bin is commercially available under the trade designation of "Top Dry" from Grain Systems, Inc. of Assumption, Ill., the assignee of the present invention. In such a batch dryer/storage bin, grain to be dried is first deposited on a sloped, perforated drying floor located in a top portion of the bin. The grain on this sloped drying floor forms a layer of grain to be dried and this layer is of generally a uniform thickness and it constitutes the batch of grain to be dried. Heated air is then directed into the interior of the bin below the drying floor and is forced up through the perforated drying floor and through the layer of grain to be dried be a heater/blower unit mounted on the bin. After drying, a plurality of chutes located about the periphery of the drying floor are opened. The dried grain flows down the sloped drying floor and is dumped or falls into a storage area located beneath the drying floor. A new batch of grain is then deposited on the floor and the process repeated. The bottom portion of the bin has a raised, perforated floor which supports the dried grain dumped into the storage area of the bin after it has been dried on the drying floor. A heater/fan unit may be operated to force either heated or ambient air beneath the raised floor in the bin so as to further dry or condition the grain that has been dumped into the bin storage area of the and which is supported on the raised floor. In certain instances, by forcing ambient or heated air through the grain in the lower portion of the bin, heat from the grain dumped into the bin from the drying floor can be recovered and as the heated air from within the bin is forced upwardly through the perforated drying floor, this recovered heat may be used to at least in part aid in drying the next batch of grain deposited on the drying floor.

It is often desirable to sample and test the grain on the drying floor or the dried grain which has been dumped into the bin below the drying floor to determine the condition of the grain being dried on the drying floor and/or to determine the condition of the dried grain within the bin so that it can be determined whether additional drying is required and the extent to which further drying is required. It will be appreciated that the characteristics or properties of grain being dried on the drying floor can vary from location to location on the drying floor. For example, the condition of the grain being dried on the drying floor can vary depending whether the sample of the grain is taken at the eave, peak or mid-section of the sloped drying floor. Further, due to the depth of the grain layer on the drying floor, the condition of the grain can vary depending on whether the sample is taken close to the drying floor at the bottom of the grain layer or near the upper surface of the grain layer. Of course, if the grain sample taken is not representative of the average condition of the batch of grain being dried, then subsequent drying and conditioning steps may not fully dry or condition the grain, as intended. Accordingly, it is desirable to be able to efficiently obtain a sample from any batch that is representative of that batch and to do so in such a way as to not interfere with the normal grain drying processes.

SUMMARY OF THE INVENTION

Among the several objects of the present invention may be noted the provision of a grain sampler for a batch grain dryer/grain storage bin for drying and storing various types of grain which obtains the sample from all portions of the batch of grain being dried so as to be a representative sample of the entire batch;

The provision of such a bin in which samples of the grain are taken as the grain is being conveyed to the storage area from the drying floor;

The provision of such a bin having a sample collector located on an outside wall of the bin, the grain samples being deposited in the collector as the grain is dumped from the drying floor into the storage bin below the drying floor for subsequent retrieval and testing;

The provision of such a grain sampler which employs a splitter assembly between the grain sampler and grain collector for splitting the flow of diverted grain so only a portion of the grain flowing past a point at any given is diverted for collection as the sample, and the remainder is returned to the grain storage area;

The provision of such a grain sampler in which the sample is collected slowly as the batch of grain is dumped from the drying floor to the bin so that the sample is collected from all regions of the batch of grain being dried from the eave to the peak of the drying floor and throughout the entire depth of the grain batch;

The provision of such a bin in which collection of a grain sample is automatically performed any time dried grain is conveyed from the drying floor to the storage area; and, The provision of such a bin in which grain samples are collected in an efficient, low cost manner regardless of the type of grain stored.

In accordance with the invention, generally stated, apparatus is disclosed for sampling grain from a stream of grain flowing along a path. This apparatus comprises means for diverting a portion of the flowing grain from the path to a sampling path, means for diverting only a portion of the grain flowing along the sampling path to a collection path and for discharging the balance of the grain flowing along the sampling path, and means for collecting at least a portion of the grain flowing along the collection path so as to accumulate grain for a sample that is representative to all of the grain flowing along the path for the time the grain is being collected for the sample.

More specifically, this invention relates to a grain drying bin for the batch drying of grain. The drying bin has a drying floor with a sloped surface onto which a layer of grain to be dried is placed for being heated by heated air forced through the floor and the layer of grain from below so as to dry the grain. The bin has a sidewall and the sloped drying floor is located within the upper portion of the bin with the outer margin of sloped floor being adjacent the interior surface of the bin sidewall. Grain reposing on the floor after it has dried is moved from the sloped drying floor within the bin to a grain storage area located within the bin beneath the drying floor. Apparatus of this invention is provided for sampling the grain as it flows from the drying floor to the storage area includes at least one chute positioned about the periphery of the drying floor for directing a stream of grain from the drying floor to the storage area. Such chute is movable between a first or stored position in which the flow of grain through the chute is blocked to a second or discharge position in which the chute receives grain from the drying floor and directs the stream of grain to the storage area. A grain sampling tube or diverter is attached to chute for diverting a portion of the grain flowing down the chute. The grain discharged from the diverter tube is discharged into a grain flow splitter which divides this flow of grain between a collection container and the storage area of the bin. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1:
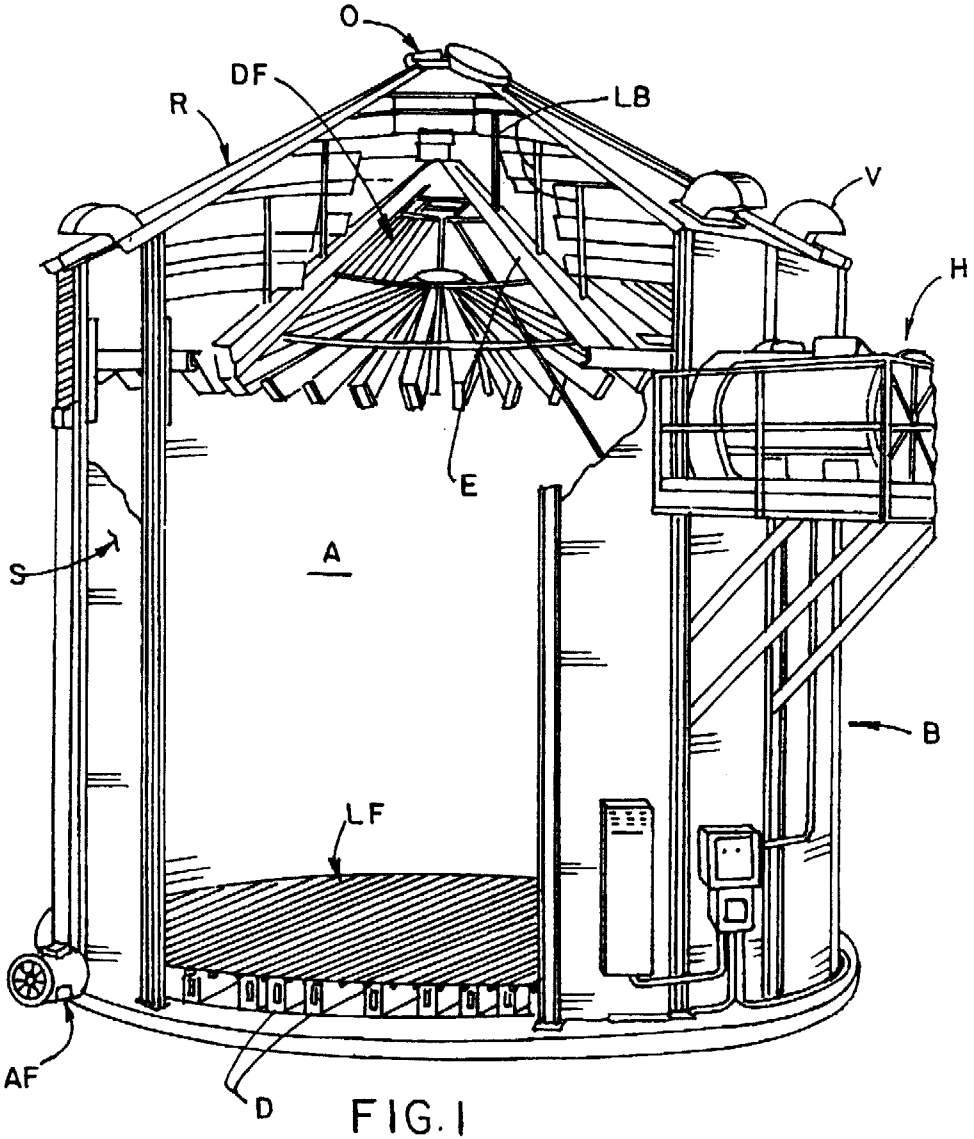
FIG. 1 is a cutaway view of a batch type grain drying/storage bin having a sloped drying floor in the upper portion of the bin on which a batch of grain is supported as it is dried and a lower grain storage/conditioning area in which the dried grain discharged from the drying floor may be further dried or conditioned, and further illustrating a plurality of selectively actuable chutes for discharging a batch of dried grain from the drying floor into the storage area.

Referring to the drawings, a batch-type grain dryer/storage bin is indicated in its entirety as B. The bin is shown to be of generally circular cross section and to have a conical roof R with an opening O formed at the peak of the roof. Fitted inside the bin, near the top of the bin, is a sloped grain drying floor DF. This floor is also conical in shape, having a peak immediately beneath the opening O in the roof, and sloping downwardly and outwardly toward a circular sidewall S of the bin. The drying floor DF is formed over rafters E which are attached to the bin sidewails S. The drying floor is comprised of sheets which are perforated to allow air to be forced from below through the floor and into (and through) a layer or batch of grain supported on the upper surface of the drying floor. The floor sheets are generally wedge-shaped channels with outwardly extending flanges which fit over the tops of adjacent rafters to fit the sections in place. The floor, when assembled, comprises a series of circumferentially spaced channels extending down from the peak of the drying floor to the caves of the drying floor adjacent the sidewalls of the bin. Grain to be dried is poured through opening O in the bin roof. The grain falls into the channels comprising the floor and thus forms a layer or batch of grain to be dried on the upper face of the drying floor. As shown in FIG. 1, leveling bands LB are provided on the upper face of the drying floor so as to aid in providing a uniform layer of grain to be dried.

Once a sufficient amount of grain has been deposited on the floor, a grain drying heater/blower unit, as indicated in its entirety at H, mounted to the bin sidewall at a level below the lower edge of the floor, is turned on to force heated air into the bin below the level of the drying floor DF with a sufficient static pressure above atmospheric pressure such that the space within the bin beneath the bin constitutes a plenum for the heated air and such that the heated air within this plenum is uniformly distributed under the entire bottom area of the drying floor. In this manner, the heated air is forced through the perforated floor into (and through) the layer of grain thereon. As the heated air flows through the layer of grain, the grain is warmed and moisture is carded from the grain and is discharged from the drying chamber via roof vents V provided on roof R. This drying process can be varied in accordance with the type of grain being dried, and the perceived or measured moisture content of the grain.

Once the drying process is complete, the batch of grain supported on the drying floor DF is conveyed from the upper drying chamber to a lower a storage area A within the bin beneath drying floor DF. The grain supported on drying floor DF is gravity conveyed or discharged from the drying floor to the storage area A of the bin by plurality selectively actuable discharge chutes 12. Each of these chutes is selectively movable from a closed position in which the chutes are generally horizontal to a discharge position in which the chutes inclining downwardly. As the chutes move between their opened and closed positions, a respective discharge opening DO is opened and closed such that with the chute and the discharge opening opened, grain on the drying floor is free to flow down the inclined drying floor DF, through the discharge opening, and down the chutes into the storage area. It will be understood that, depending on the diameter of bin B and the depth of the layer of grain on the drying floor DF, it typically will take several minutes for the grain to be discharged from the drying floor via the chutes 12. In the manner well known in the art, the chutes may be simultaneously moved between their open and closed positions by a winch and cable arrangement.

The grain discharged from the drying floor is deposited on a perforated lower floor LF which is installed at the base of the bin. This lower floor is raised above the ground (or slab) by means of support legs D which define another plenum between the floor LF and the slab supporting the lower floor. An aeration fan AF (or another heater/fan unit) is located outside the bin at or near ground level is in communication with this lower plenum for drawing ambient air from the outside of the bin and into the lower plenum where the air is forced through the perforated lower floor LF into the grain on the upper surface thereof. As the air from the aeration fan AF is forced up through the layer of dried grain on the lower floor LF, it picks up heat from the grain and thus recovers at least some of the heat from the dried grain and mixes with the heated air forced into the bin by heater bin H. In addition, this conditioning air forced beneath floor LF by aeration fan AF cools the grain, and, depending on the condition of the grain and the humidity of the ambient air, may further aid in drying of the grain once it has been discharged from the drying floor DF onto the lower floor LF. The above described process can be repeated for subsequent batches of grain until storage area A is filled with dried grain. Of course, the grain in storage area A may be conveyed from the bin to trucks or to other storage bins. Those skilled in the art will appreciated that the grain on the lower floor LF may be unloaded therefrom in the conventional manner by means of a sweep auger or the like (not shown).

Figure 2:
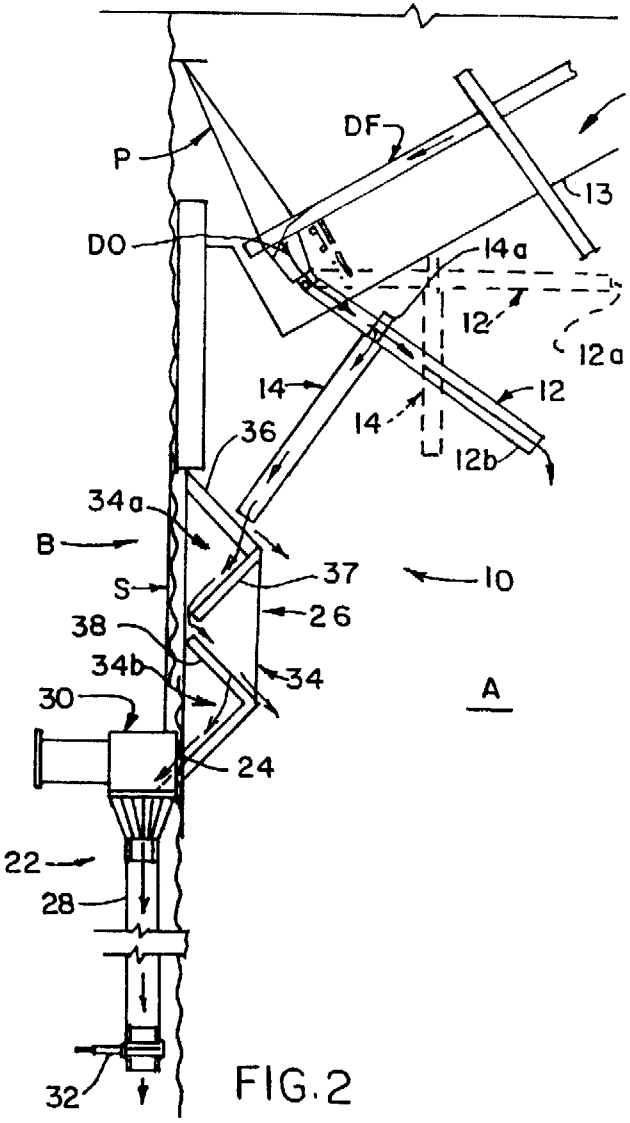
FIG. 2 is a vertical, partial sectional view of a section of the bin illustrating a grain sampling and sample collection means of the present invention.

Referring now to FIG. 2, an apparatus 10 of the present invention is provided on bin B for sampling grain as it flows from floor DF to grain storage area A beneath the drying floor for obtaining a representative sample of the grain on the drying floor through its depth and from the eave to the peak of the drying floor while the grain is discharged from the drying floor by means of discharged chutes 12. Grain samples may be taken from each batch of grain to determine the final moisture content of the grain and to determine the degree of aeration or further drying that is required of the grain deposited on the lower floor LF. This information is then used to determine if the batch drying times are of the correct length and if the drying temperature is too high or too low.

Figure 4:
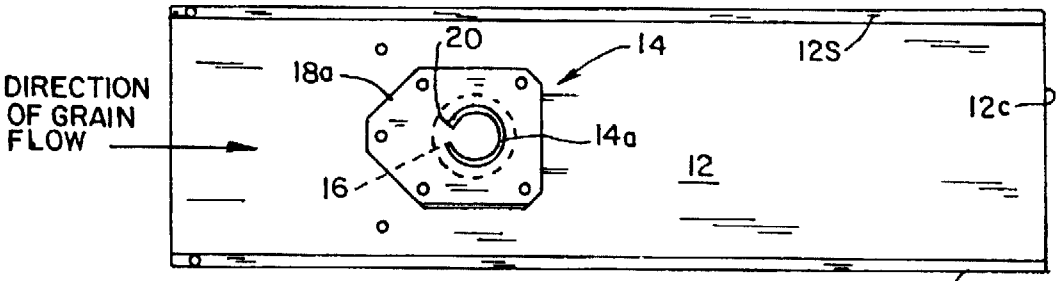
FIG. 4 is a top plan view of the chute and sampling tube having a collection slot therein for intercepting only a portion of the grain flowing down the chute for sampling such grain.
Figure 3:
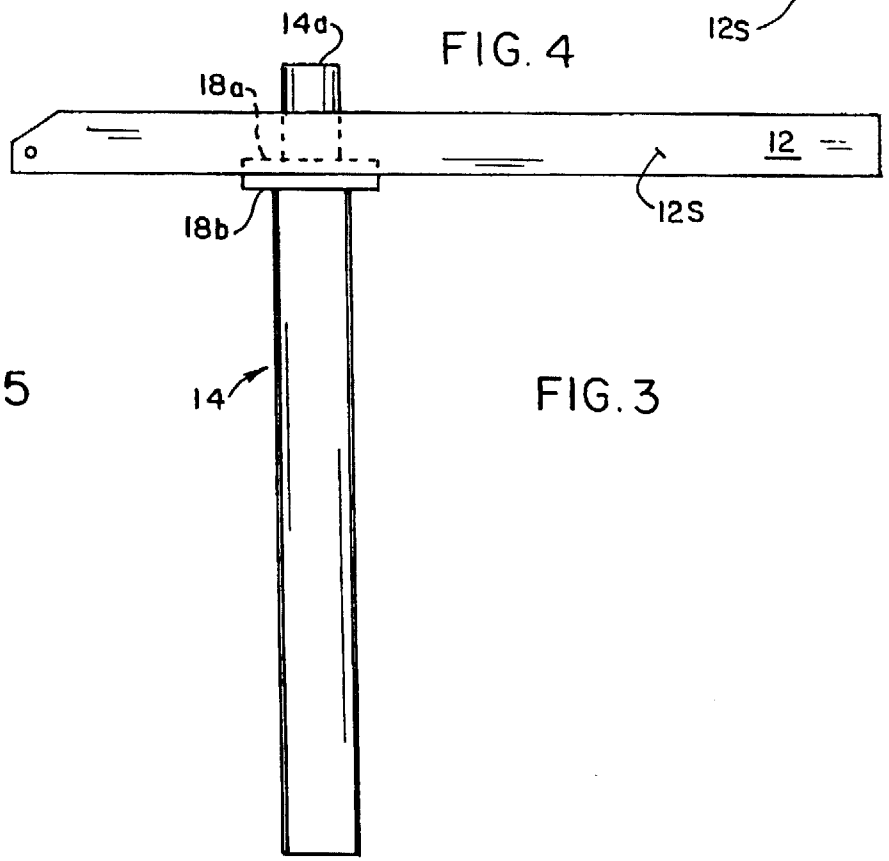
FIG. 3 is a side elevational view of a grain chute having a grain sampling tube attached thereto.
Figure 5:
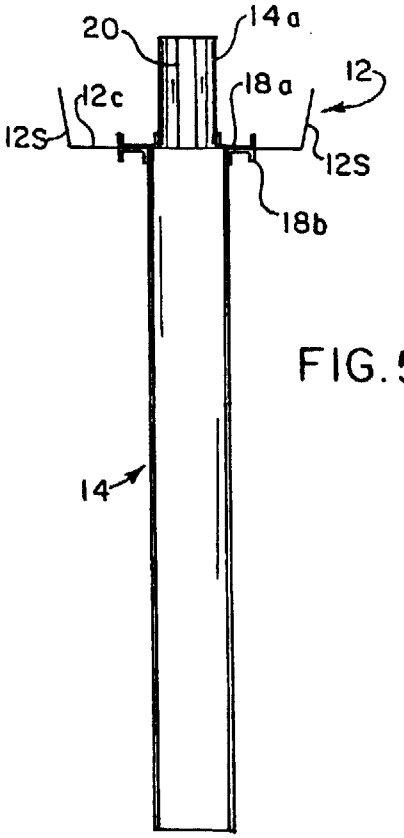
FIG. 5 is a front elevational view of the chute and tube shown in FIG. 4.

As shown in FIG. 2, the outer edge of floor DF stops short of sidewall S of the bin. Flashing plate FP which angles upwardly and outwardly from the outer margins of the sloped drying floor DF (i.e., from the eaves of the drying floor) to the inside surface of the bin sidewall so as to prevent the collection of grain between the lowest reaches of the drying floor (i.e., below discharge openings DO) and the bin sidewall. As previously noted, apparatus 10 first includes a plurality of discharge chutes 12 positioned at generally equal angular intervals from one another around the drying floor DF for discharging grain from the drying floor to storage area A. Each chute is installed beneath floor DF, and in particular, beneath the outer end of each channel comprising a section of floor DF. Further, each chute is hingedly connected being is associated section of floor DF so to be movable from a first (or closed) position (shown in dotted lines m in FIG. 2) to a second (or open) position (shown in solid lines FIG. 2) in which the chute allows grain to flow from the drying floor to the storage area. As shown in FIGS. 3–5, chute 12 is a metal chute having a general channel shaped cross section. The base or web 12*c* of the chute is flat, and the respective sidewalls or flanges 12*s* of the chute extend outwardly from the base. The chutes are mechanically operated in the manner well known to those skilled in the art via a winch and cable arrangement to move them from their stored or closed position (as shown in dotted lines shown in FIG. 2) to extended or discharge position (as shown in solid lines in FIG. 2). Those skilled in the art will recognize that means other than a cable and winch arrangement, such as a liner actuator, may be used to raise and lower chutes 12. As is typical, all of the chutes are moved between their open and closed positions substantially simultaneously. When the chutes are lowered or opened, grain reposing on a section of floor DF, flows into a discharge opening DO in the drying floor and onto the upper end of the discharge chute.

Apparatus 10 includes a sampling means 14 or the present invention which is attached to one of the chutes 12 for obtaining a sample portion of the grain flowing through the chute and directing it away from the chute for collection and subsequent testing. As shown in FIGS. 3–5, sampling means 14 comprises a hollow, cylindrical tube which is attached to base 12*c* of the chute for diverting only a small portion of the grain flowing down the chute throughout the time the grain flows from the drying floor DF to the storage area A. An opening 16 is provided in the base 12*c* of a chute, and the upper end 14*a* of the sampling tube 14 extends through this opening and into the grain stream flowing down the chute. This height of this end of the tube is such that it projects above the sidewalls of the chute. Respective mounting plates 18*a*, 18*b* are attached to the opposite sides of the base of the chute to position the sampling tube and hold it in place. A vertical slot 20 is formed in tube section 14*a*, and as shown in FIG. 4, the slot is oriented to face toward the grain flowing through the chute. Accordingly, when the chute is lowered and grain is flowing down the chute, a portion of the grain being conveyed down the chute will flow into slot 20 of the tube and fall through the tube away from the remainder of the chute. The remainder (preferably the vast majority of the grain) will continue to flow down the and to be discharged into the storage area A of the bin.

Figure 8:
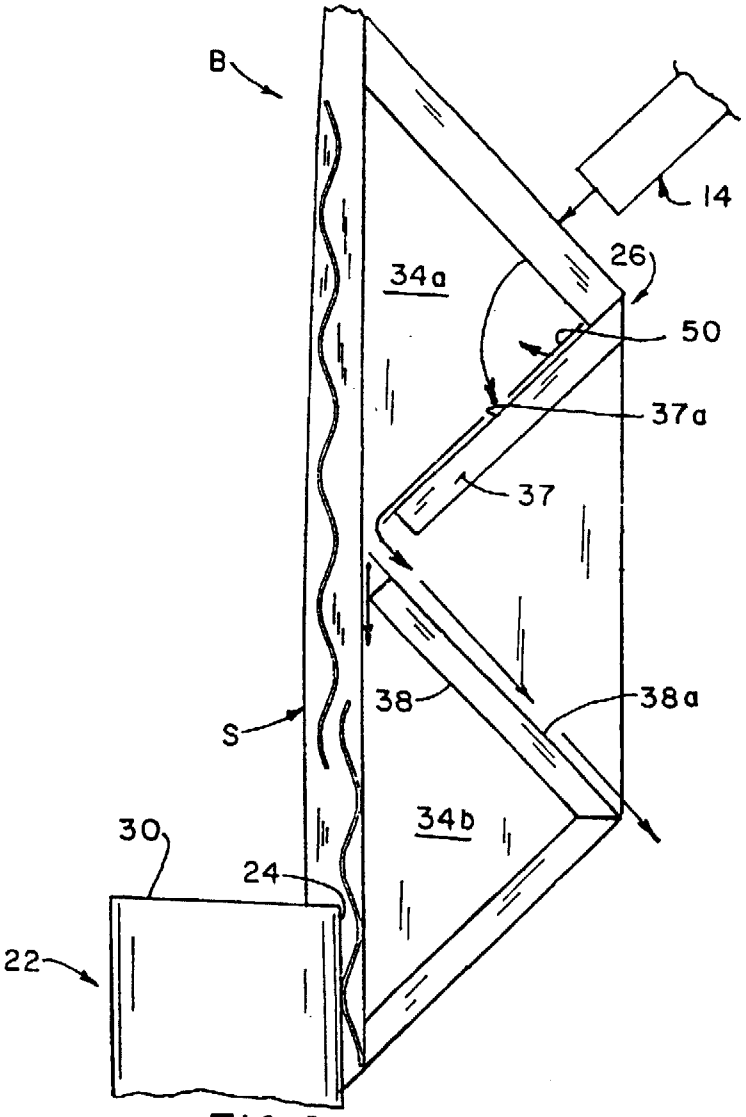
FIG. 8 is a partial elevational view of the bin illustrating installation of the grain splitter assembly.
Figure 7:
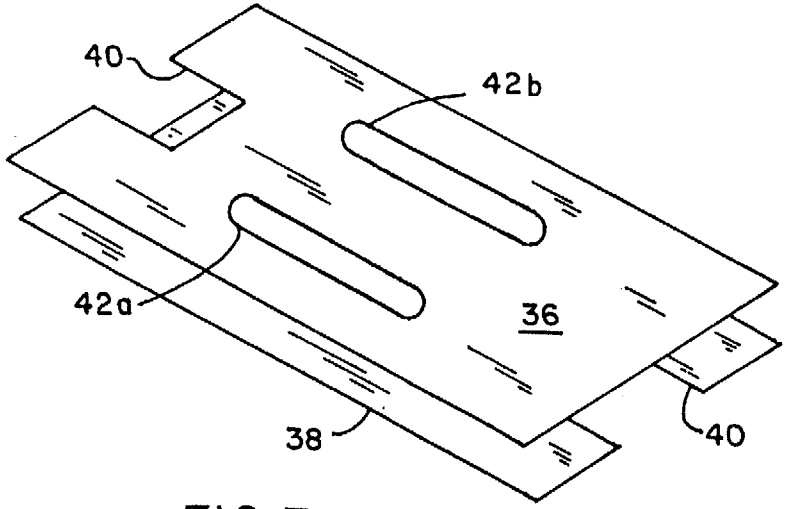
FIG. 7 is a perspective view of a pair of grain splitter plates forming a portion of a splitter assembly.

As shown in FIGS. 2, 7, and 8, a sample collector 22 is provided on the outside of bin wall S below the level of sampling means 14 and it is to this collector that a portion of the grain flowing down chute 12 is directed for retention as a sample of the grain layer on the drying floor DF for subsequent testing. An opening 24 is provided in bin wall S above the level of collector 22. The grain diverted from the main flow of grain down chute 12 by tube 14 falls from the lower end of tube 14 into a grain flow splitter 26. In accordance with this invention, only a small portion of diverted grain entering the splitter 26 reaches the bottom of the splitter with the remainder of the diverted grain being discharged from the splitter into the storage area A of bin B. Collector 22 includes a sample box 30 is mounted to the outside of bin sidewall S at opening 24 and this sample box receives grain from splitter. A collection tube 28 is in communication with box 30 and grain from the box is deposited in collection tube 28 so as to constitute the grain sampled during the entire time grain flows down chute 12. Grain flowing into opening 24 is funneled through box 30, into tube 28, where it falls to the bottom of the tube. A slide valve 32 is located at the lower end of collection tube 30. The grain falling into the collection tube is retained in the tube until an attendant desiring a sample opens valve 32 to remove the grain sample for testing. It will be appreciated that because of the height of the bin, and the storage capacity of the bin, the position of the upper end of the collection tube may be well above the ground upon which the bin is constructed. Consequently, tube 28 may be of such length that the lower end of the tube, where valve 34 is located, is within easy reach of the person taking the sample.

As previously noted, flow splitter 26 is interposed between sampling tube 14 and sample collection means 22. Flow splitter 26 functions to divide the flow of grain through tube 14 so that only a portion (preferably only a small fraction) of the grain flowing through tube 14 is directed to collection tube 28, with the remainder of the grain being redirected back to the storage area of the bin. It will be understood that even though slot 20 in sampling tube 14 is relatively narrow, interposition of the sampling tube inlet directly in the grain flow path through chute 12 means a substantial quantity of grain will be diverted into the sampling tube. However, only a small quantity of grain is required for moisture content measurements. Allowing all of the sampled grain to be diverted for collection would cause wastage and would fill any reasonably sized sample container before the grain from the drying floor was fully unloaded into the storage area A. Grain splitter means 26 serves to further divide the grain flow so only a small portion of the sample diverted from the grain flowing down the chute 12 actually reaches the collection tube, while the remainder is discharged back into the storage area of the bin. It will be further appreciated that with the grain diverter 14 and with the grain splitter 26, only a small percentage of the grain flowing down discharge chute 12 is collected in collection tube 28 at any time such that grain may be collected for the full time that grain from the drying floor DF is discharged from the drying floor to the storage area. In this manner, it is insured that the sample collected in collection tube 28 is representative of the entire layer of grain dried on the drying floor from the eaves of the drying floor to the peak and from the bottom of the layer adjacent the drying floor to the upper surface of the grain layer. In such manner, the grain sample collected in the collection tube is accumulated over the period of time that grain is being discharged from the drying floor so that an average sample is collected which accurately reflects the condition of the grain dried on the drying floor and thus allows decisions as to changes in the drying time of the next batch of grain or the length of time that the grain on the aeration floor should be aerated by aeration fan AF.

Figure 6:
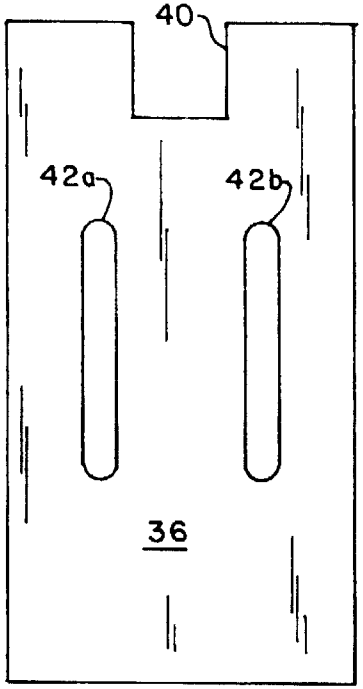
FIG. 6 is a top plan view of a grain splitter plate used with the sampling means and collection means shown in FIG. 2 for diverting the majority of the grain sample and for retaining only a small portion of the grain sample being collected.

Grain splitter means 26 includes an assembly 34 which is mounted on the inside of the bin sidewall. The assembly is installed so grain falling through sampling tube 14 enters the upper end of the assembly through an opening in the top wall of the assembly, as indicated by the arrows in FIG. 2. The lower end of the assembly is in communication with opening 24 in the bin sidewall S for collection of a portion of the grain entering the splitter in collection tube 28 and for returning the majority of the grain entering the splitter into the storage area A of bin B. The grain splitter comprises an upper section 34*a* and a lower section 34*b*. Upper section 34*a* comprises cover plate 36 which is inclined with respect to the sidewall of bin B so as to be substantially perpendicular to tube 14 and is positioned, as shown in FIG. 2, to be in close proximity to the discharge end of tube 14. Cover plate 36 has an opening therein (not shown) which is generally in register with the open end of diverter tube 14 such that grain discharged from the tube enters the grain splitter assembly 34. As shown in FIG. 6, once the grain from tube 14 has entered the splitter assembly, it flows down the upper surface 37*a* of an upper inclined plate 37 which is inclined downwardly and outwardly toward the bin sidewall S. The upper surface 37*a* of plate 37 is so structured that the grain flowing theredown is substantially uniformly spread out so as to form a layer of substantially uniform thickness. As best shown in FIG. 8, this uniform flow of grain spills off the lower end of plate 37 and impinges on the upper end of a second inclined plate 38. As shown in FIG. 8, plate 38 has a notch 40 in its upper end which receives the grain from upper plate 36. This notch allows a portion of the grain discharged from the upper plate to fall below the lower plate 38 into the lower section 34*b* of the grain splitter assembly 34. Plate 38 has slots 42*a*, 42*b* receive adjustment screws (not shown) which in turn allow the plate to be adjusted lengthwise on its support 38*b*, as shown in FIG. 8, so that the notch 40 at the upper end of the plate may be adjusted relative to the stream of grain discharged from the upper plate 36. It will be further understood that adjustment plates (not shown) may be provided on the upper surface 38*a* of plate 38 so that the effective size of notch 40 may be made smaller so that the notch will only pass a small portion of the grain impinging thereon. It will be appreciated if it is desired to accumulate the sample of grain over a longer period of time, or if the size of the grain being sampled (e.g., milo or rapeseed) is small (as compared with corn), the full size of notch 40 would totally fill the sample collection tube 28 is too short a time. However, if a portion of the notch area were blocked off, a smaller quantity of grain from the upper plate 36 would be allowed to pass into the lower section 34*b* of the grain splitter.

It will be further understood that if a very slow rate of grain accumulation is desired in collection tube 28, another set of plates 36 and 38 may be provided within grain splitter 34 below the plates 36 and 38 shown so as to again divide the flow of grain to only a small fraction of the grain permitted to flow through the notch 40 of the upper most plate 38.

Further in accordance with this invention, grain splitter assembly 34 is provided with a selectively operable gate 50 which is normally open, but when closed blocks the flow of grain from the end of grain diverter tube 14 into grain splitter 34. This gate is shown to be a spring loaded door which is biased toward its open position and a cable arrangement (not shown) for selectively dosing the door.

In this manner, for the time (e.g., several minutes) it requires for a layer of grain to be discharged from the drying floor DF via chute 12 into storage area A, a small portion of the grain flowing down one of the chutes is continuously diverted to the sample collector 22. Thus, the grain collected in collector 22 is representative of all of the grain on the drying floor from peak to eave and throughout the thickness of the layer of the grain.

It will be further appreciated that while the sampling apparatus 10 of the present invention has herein been described as for use with a batch grain dryer, those skilled in the art will recognize that the sampler of the present invention may be used to obtain a representative sample of any stream of flowing grain over a desired time period, and need not be used only with a batch type grain dryer.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for sampling grain from a stream of grain flowing along a path, said apparatus comprising means for diverting a portion of said flowing grain from said path to a sampling path, means for splitting said grain flowing along said sampling path to a collection path and for discharging the balance of said grain flowing along said sampling path, and means for collecting at least a portion of said grain flowing along said sampling path so as to accumulate grain for a sample that is representative to all of said grain flowing along said path, wherein said grain splitting means comprises a first inclined surface sloping downwardly in a first inclined direction which receives said grain from said sampling path, and a second inclined surface sloping downwardly at a second inclined direction generally oppositely from said first inclined direction, means for transferring at least a portion of the grain flowing down said first inclined surface to said second inclined surface, and means associated with said second inclined surface for allowing only a portion of said grain flowing down said second surface to constitute said grain flowing down said collection path.

2. Apparatus for sampling grain discharged from a batch grain dryer, said dryer having a sloped drying floor which supports a batch of grain to be dried, said grain dryer having a plurality of discharge chutes for discharging said batch of grain from said drying floor, means for sampling grain from a stream of grain flowing along one of said discharge chutes, said apparatus comprising means for diverting a portion of said grain flowing in said stream to a sampling path, means for splitting said grain flowing along said sampling path to a collection path and for discharging the balance of said grain flowing along said sampling path, and means for collecting at least a portion of said grain flowing along said sampling path so as to accumulate grain for a sample that is representative to all of said grain flowing along said path, wherein said diverting means comprises a diverter which extends up into said one discharge chute for intercepting only a portion of said steam of grain flowing down said one chute and for diverting said portion of said stream of grain flowing along said one chute to said sampling path.

3. Apparatus as set forth in claim 2 wherein said batch grain dryer comprises a bin having said sloped drying floor located above the floor of said bin, said bin having a generally vertical bin wall, with said sample container being located on the outside of said bin wall.

4. Apparatus as set forth in claim 3 wherein said collection means is located on the inside of said bin wherein said bin wall has an opening therethrough between said collection means and said sample container, and wherein said collection means has a flow path for said grain flowing along said collection path leading from said collection means on the inside of said bin through said opening to said sample container on the outside of said bin.

5. Apparatus as set forth in claim 4 wherein said sample container has a valve for allowing the withdrawal of a sample of grain from said sample container or for the emptying of said sample container.

6. Apparatus for sampling grain reposing on a sloped drying floor of a batch grain dryer/storage bin as a batch of grain dried on said sloped drying floor is discharged therefrom and is allowed to flow into said bin therebelow, said apparatus comprising:

means located about the outer lower margins of said sloped drying floor for selectively permitting the flow of said grain from the drying floor to said bin below said drying floor;

sampling means for directing a sample of the grain flowing from said drying floor representative of the grain on the drying floor from one end to the other of said sloped drying floor and from the grain adjacent to said drying floor to the upper surface of said grain supported on said drying floor as said grain is permitted to flow from said drying floor; and, sample collecting means to which the sample portion of the grain is directed for retaining the sample portion for collection so the sample portion can be tested to determine particular characteristics thereof.

7. Apparatus as set forth in claim 6 wherein said means for permitting the flow of said grain from said sloped drying floor includes at least one chute positioned adjacent the outer, lower margin of said sloped drying floor, said chute being movable between a first position in which the flow of grain from said drying floor to said chute is blocked and second position in which grain is free to flow from said drying floor onto said chute for discharge into the storage area of said bin beneath said drying floor.

8. Apparatus as set forth in claim 6 wherein said means for permitting the flow of said grain from said sloped drying floor includes a plurality of chutes spaced about the periphery of the drying floor for allowing grain to flow from the drying floor to the storage area.

9. Apparatus as set forth in claim 8 wherein the sampling means includes a grain sampling tube having an inlet end attached to one of said chutes for intercepting a portion of the grain flowing down said one chute and for diverting said portion of said grain to said sample collection means and for allowing the remainder of said grain flowing down said one chute to flow into the storage area.

10. Apparatus as set forth in claim 9 wherein the inlet end of the grain sampling tube extends above the base of said chute, said inlet end of said tube extending above the channel base having a slot therein through which grain enters the tube.

11. Apparatus as set forth in claim 10 wherein the collecting means includes a collection tube in communication with the grain sampling tube, the collection tube having an open, inlet end into which the sample portion of the grain is directed from the grain sampling tube, and a closed end in which the sample portion of the grain is retained until the grain sample is collected for testing.

12. Apparatus as set forth in claim 11 further including splitter means interposed between the sampling means and the sample collecting means.

13. Apparatus as set forth in claim 12 wherein the splitter means includes a grain flow splitter for dividing the flow of grain between the outlet of the grain sampling tube and the collection tube so as to return the major portion of said grain flow to said storage area.

14. Apparatus as set forth in claim 13 wherein the flow splitter includes a first inclined plate onto which grain flowing from the outlet end of the grain sampling tube spills, said first plate having a plurality of openings therein through which only a portion of the grain flowing out of the end of said sampling tube with the remainder of such grain flowing off the plate falling into the storage area with the rest of the grain.

15. Apparatus as set forth in claim 14 wherein the grain splitter further includes a second inclined plate disposed beneath the first plate and set an angle to the first plate for grain falling through the openings in the first plate to spill onto the upper surface of the second plate and flowing over the second plate toward an inlet to of the sample collection tube.

16. Apparatus as set forth in claim 14 wherein the storage bin has a sidewall and the grain sampling tube and grain splitter are installed on the inside of the sidewall and the grain collection tube is installed on the outside of the sidewall with an opening through said sidewall for permitting grain to flow from said grain splitter to said collection tube.

17. In a grain drying bin for drying grain, the bin having a drying floor having a sloped surface onto which grain is placed for heated air to be directed through the grain to dry it, the bin having a sidewall and the drying floor being located within the upper region of said bin, a layer of grain reposing on the drying floor after it has dried being moved from the floor of the bin to a bin storage area located beneath the floor, apparatus for sampling grain as it flows from the drying floor to the storage area comprising:

a plurality of chutes positioned about the periphery of the floor for conveying grain from the drying floor to the storage area, each chute being movable from a first or closed position to a second or open position in which the chute allows grain to flow from the drying floor to the storage area;

sampling means attached to one of the chutes for collecting a sample portion of the grain flowing down said one chute and for diverting it away from said one chute;

sample collection means receiving said grain diverted from said chute, said sample collection means retaining only a portion of the diverted grain for subsequent collection and testing; and, flow splitter means interposed between the sampling means and the sample collection means, said flow splitter means including a grain flow splitter for dividing the flow of diverted grain between the sampling means and the sample collection means, with only a portion of the sampled grain being directed to the collection means with the remainder being directed to the storage area of the bin.

18. Apparatus as set forth in claim 17 wherein the sampling means includes at least one grain sampling tube having an inlet end extending into the grain flowing down the chute.

19. Apparatus as set forth in claim 18 wherein an inlet end of the has a slot therein through which grain flowing down said chute enters the tube.

20. Apparatus as set forth in claim 19 wherein the sample collection means includes a collection tube in communication with the sampling tube for collecting a sample portion of the grain directed through the flow splitter means to the collection tube.

21. Apparatus as set forth in claim 20 wherein the flow splitter means includes a flow splitter having an upper section and a lower section, each section including a first inclined plate and a second inclined plate placed at an angle to each other with the first plate being above the second plate, each plate having at least one opening therein through which only a portion of the grain impinging on said plate fails from the first plate onto the second plate and from the second plate to said collection tube with the remainder of such grain being discharged into the storage area.

* * * * *